US007398025B2

(12) United States Patent
Campbell et al.

(10) Patent No.: US 7,398,025 B2
(45) Date of Patent: Jul. 8, 2008

(54) WHITE VECTOR FEEDBACK ADJUSTMENT

(75) Inventors: Alan Stirling Campbell, Lexington, KY (US); Albert Munn Carter, Jr., Richmond, KY (US); Cary Patterson Ravitz, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 115 days.

(21) Appl. No.: 11/126,814

(22) Filed: May 11, 2005

(65) Prior Publication Data

US 2006/0257159 A1 Nov. 16, 2006

(51) Int. Cl.
*G03G 15/00* (2006.01)

(52) U.S. Cl. ..... 399/49; 399/51; 399/55; 399/66

(58) Field of Classification Search ..... 399/49, 399/53–56, 60, 64, 74, 51, 66
See application file for complete search history.

(56) References Cited

U.S. PATENT DOCUMENTS 5,477,312 A * 12/1995 Hori ..... 399/74
6,560,418 B2 * 5/2003 Campbell et al. ..... 399/49
2005/0063718 A1 * 3/2005 Oki ..... 399/49

* cited by examiner

*Primary Examiner*—David M Gray
*Assistant Examiner*—Ryan D. Walsh
(74) *Attorney, Agent, or Firm*—Coats & Bennett, PLLC

(57) ABSTRACT

Control circuitry associated with an electrophotographic imaging device is adapted to operate in conjunction with a sensor to adjust a difference in electrical bias between a photoconductive surface and an associated roller. The sensor detects a reflectance or luminosity of a developed image and the control circuitry uses this detected information and information related to reflectance or luminosity of the underlying surface and the developing toner to determine whether the developed image is produced as desired. The control circuitry adjusts the difference in electrical bias between the photoconductive surface and an associated roller in response to a comparison between the detected and desired images. In one embodiment, a predetermined test pattern is developed over a range of electrical bias differences and an optimum operating point is determined from the iterations.

23 Claims, 8 Drawing Sheets

WHITE VECTOR FEEDBACK ADJUSTMENT

BACKGROUND

The electrophotography process used in some imaging devices, such as laser printers and copiers, utilizes electrical potentials between components to control the transfer and placement of toner. These electrical potentials create attractive and repulsive forces that tend to promote the transfer of charged toner to desired areas while ideally preventing transfer of the toner to unwanted areas. For instance, during the process of developing a latent image on a photoconductive surface, negatively charged toner particles may be deposited onto more positively charged latent image features (e.g., corresponding to text or graphics) on the photoconductive surface. At the same time, the negatively charged toner particles may be prevented from transferring or migrating to more negatively charged areas (e.g., corresponding to the document background) of the same photoconductive surface. In this manner, imaging devices implementing this process may simultaneously generate images with fine detail while maintaining clean backgrounds.

The precise magnitudes of these electrical potentials and the nature of the voltages (e.g., AC or DC) varies among devices and manufacturers. In general, however, a laser or optical imaging source is used to illuminate and selectively discharge portions of a photoconductive surface to create a latent image having a lower surface potential than the remaining, undischarged areas of the photoconductive surface. The toner is charged to some intermediate level between the discharge potential of the latent image and the surface potential of the undischarged photoconductive surface. The toner may be charged triboelectrically and/or via biased toner delivery control components, such as a toner adder roll, a doctor blade, and a developer roller. The developer roller supplies toner to develop the latent images on the photoconductive surface. The developed image is ultimately transferred onto a media sheet, typically by employing yet another surface potential that attracts the toner off of the photoconductive surface (or an intermediate transfer surface) and onto the media sheet where it is ultimately fused.

The difference between the surface potential of the developer roller and the surface potential of undischarged portions of a photoconductive surface is sometimes referred to as a "white vector." An optimal white vector achieves certain desirable characteristics, one of which is to provide a clean media sheet with little or no appreciable background toner in areas other than where printing is desired. The magnitude of the white vector needed to prevent background is a function of numerous factors, including developer material, environment, imaging device components, and age. Traditionally, imaging devices incorporating an electrophotography process operate with a white vector that is fixed, but large enough to overcome the factors that contribute to unwanted background.

Very large white vector values are not necessarily the most desirable solution because, although background will be limited, the density of deposited toner and detail of the resulting image may be adversely affected. Conversely, as white vector values fall, unwanted background may begin to appear. Determining an optimal WV that is somewhere between these extremes and that accounts for the aforementioned factors and varying operating conditions is a legitimate problem that is not solved by setting a fixed operating point.

SUMMARY

Embodiments of the present invention are directed to electrophotographic image forming devices and control of a difference, sometimes referred to as a white vector, between a photoconductor surface potential and a surface potential of an associated developer roll. The white vector may be controlled and adjusted via one or more control circuits adapted to control the formation of a predetermined image pattern on a substrate, such as a transport belt, transfer belt, or media sheet. One or more sensor circuits may be used to detect a coverage of the developed image pattern on the photoconductor surface or on the substrate. White vector may be adjusted in response to a comparison between the detected coverage of the developed image and a desired coverage of the developed image.

For instance, in one embodiment, background noise may be used as an indicator that white vector needs to be adjusted. In another embodiment, reflectance of a developed pattern may be used to detect the coverage or bloom of the pattern relative to a predetermined standard. Iterative procedures may also be used to determine an optimum operating point.

DETAILED DESCRIPTION

Figure 1:
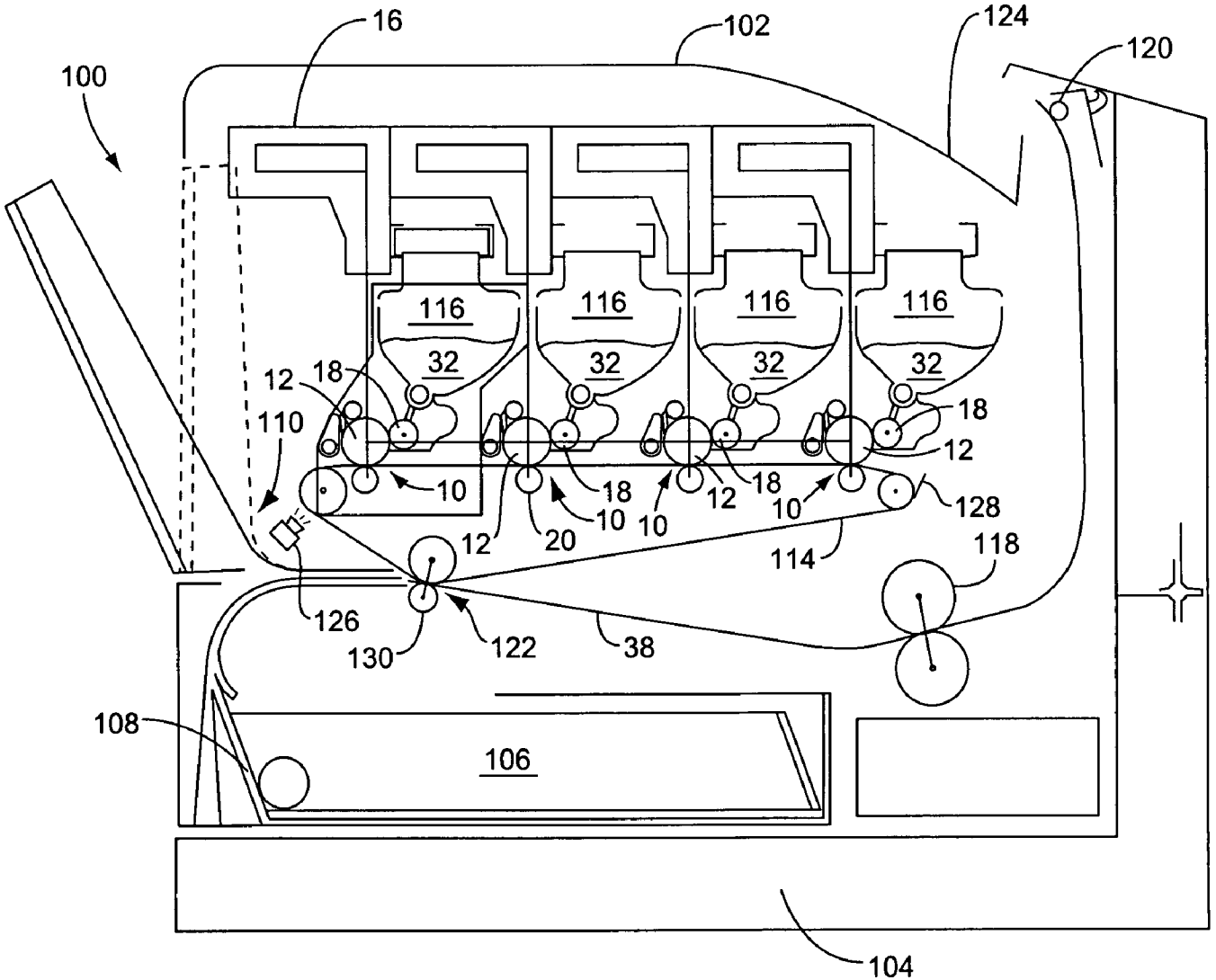
FIG. 1 is a functional block diagram of an image forming apparatus according to one embodiment of the present invention.

In electrophotographic image development, white vector is a term used to represent the difference in electrical potential between an undischarged photoconductor surface potential and a surface potential of an associated developer roll. Optimization of white vector in a device such as the image forming apparatus as generally illustrated in FIG. 1 may be achieved with various embodiments disclosed herein. FIG. 1 depicts a representative dual-transfer image forming device, indicated generally by the numeral 100. The image forming device 100 comprises a housing 102 and a media tray 104. The media tray 104 includes a main stack of media sheets 106 and a sheet pick mechanism 108. The image forming device 100 also includes a multipurpose tray 110 for feeding envelopes, transparencies and the like. The media tray 104 may be removable for refilling, and located in a lower section of the device 100.

Within the image forming device housing 102, the image forming device 100 includes one or more removable developer cartridges 116, photoconductive units 12, developer rollers 18 and corresponding transfer rollers 20. The image forming device 100 also includes an intermediate transfer mechanism (ITM) belt 114, a fuser 118, and exit rollers 120, as well as various additional rollers, actuators, sensors, optics, and electronics (not shown) as are conventionally known in the image forming device arts, and which are not further explicated herein. Additionally, the image forming device 100 includes one or more controllers, microprocessors, DSPs, or other stored-program processors (not shown in FIG. 1) and associated computer memory, data transfer circuits, and/or other peripherals (not shown) that provide overall control of the image formation process.

Each developer cartridge 116 may include a reservoir containing toner 32 and a developer roller 18, in addition to various rollers, paddles and other elements (not shown). Each developer roller 18 is adjacent to a corresponding photoconductive unit 12, with the developer roller 18 developing a latent image on the surface of the photoconductive unit 12 by supplying toner 32. In various alternative embodiments, the photoconductive unit 12 may be integrated into the developer cartridge 116, may be fixed in the image forming device housing 102, or may be disposed in a removable photoconductor cartridge (not shown). In a typical color image forming device, three or four colors of toner—cyan, yellow, magenta, and optionally black—are applied successively (and not necessarily in that order) to a print media sheet 106 to create a color image. Correspondingly, FIG. 1 depicts four image forming units 10. In a monochrome printer, only one forming unit 10 may be present.

The operation of the image forming device 100 is conventionally known. Upon command from control electronics, a single media sheet 106 is "picked," or selected, from either the primary media tray 104 or the multipurpose tray 110 while the ITM belt 114 moves successively past the image forming units 10. As described above, at each photoconductive unit 12, a latent image is formed thereon by optical projection from the imaging device 16. The latent image is developed by applying toner to the photoconductive unit 12 from the corresponding developer roller 18. The toner is subsequently deposited on the ITM belt 114 as it is conveyed past the photoconductive unit 12 by operation of a transfer voltage applied by the transfer roller 20. Each color is layered onto the ITM belt 114 to form a composite image, as the ITM belt 114 passes by each successive image forming unit 10. The media sheet 106 is fed to a secondary transfer nip 122 where the image is transferred from the ITM belt 114 to the media sheet 106 with the aid of transfer roller 130. The media sheet proceeds from the secondary transfer nip 122 along media path 38. The toner is thermally fused to the media sheet 106 by the fuser 118, and the sheet 106 then passes through exit rollers 120, to land facedown in the output stack 124 formed on the exterior of the image forming device housing 102. A cleaner unit 128 cleans residual toner from the surface of the ITM belt 114 prior to the next application of a toner image.

The representative image forming device 100 shown in FIG. 1 is referred to as a dual-transfer device because the developed images are transferred twice: first at the image forming units 10 and second at the transfer nip 122. Other image forming devices implement a single-transfer mechanism where a media sheet 106 is transported by a transport belt (not shown) past each image forming unit 10 for direct transfer of toner images onto the media sheet 106. For either type of image forming device, there may be one or more toner patch sensors 126, to monitor a media sheet 106, an ITM belt 114, a photoconductive unit 12, or a transport belt (not shown), as appropriate, to sense various test patterns printed by the various image forming units 10 in an image forming device 100. The toner patch sensors 126 may be used for, among other purposes, registering the various color planes printed by the image forming units 10. In one embodiment, two toner patch sensors 126 may be used, with one at opposite sides of the scan direction (i.e., transverse to the direction of substrate travel).

Figure 2:
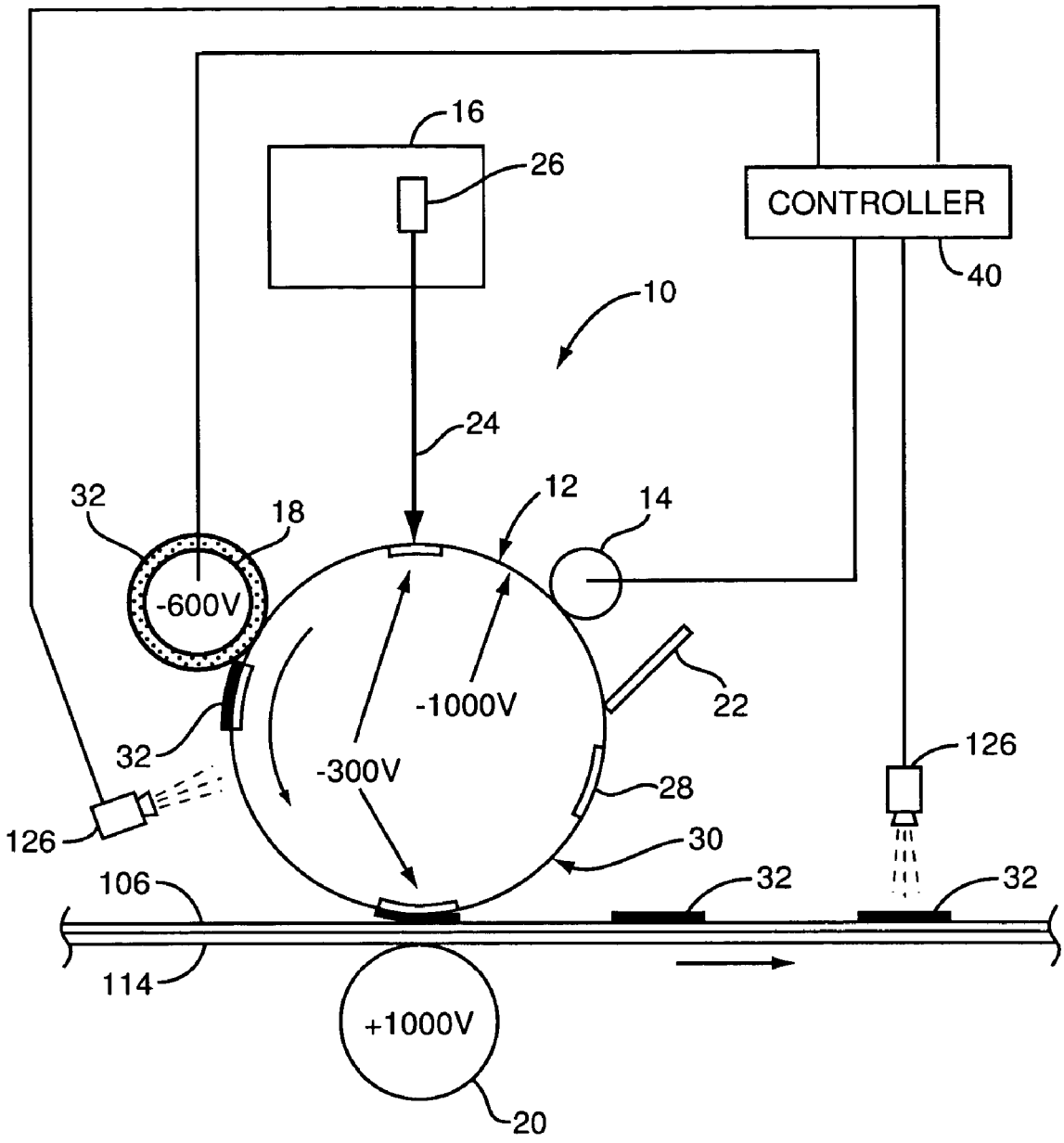
FIG. 2 is a schematic diagram of an image forming unit and white vector controller according to one embodiment of the present invention.

FIG. 2 is a schematic diagram illustrating an exemplary image forming unit 10. Each image forming unit 10 includes a photoconductive unit 12, a charging unit 14, an optical unit 16, a developer roller 18, a transfer device 20, and a cleaning blade 22. In the embodiment depicted, the photoconductive unit 12 is cylindrically shaped and illustrated in cross section. However, it will be apparent to those skilled in the art that the photoconductive unit 12 may comprise any appropriate shape or structure. The charging unit 14 charges the surface of the photoconductive unit 12 to a uniform potential, approximately −1000 volts in the embodiment depicted. A laser beam 24 from a laser source 26, such as a laser diode, in the optical unit 16 selectively discharges discrete areas 28 on the photoconductive unit 12 that are developed by toner to form a latent image on the surface of the photoconductive unit 12. The optical energy of the laser beam 24 selectively discharges these discrete areas 28 of the surface of the photoconductive unit 12 to a potential of approximately −300 volts in the embodiment depicted (approximately −100 volts over a photoconductive unit 12 core voltage of −200 volts in this particular embodiment). Areas of the latent image not to be developed by toner (also referred to herein as "white" or "background" image areas), indicated generally by the numeral 30, retain the potential induced by the charging unit 14, e.g., approximately −1000 volts in the embodiment depicted.

The latent image thus formed on the photoconductive unit 12 is then developed with toner from the developer roller 18, on which is adhered a thin layer of toner 32. The developer roller 18 is biased to a potential that is intermediate to the surface potential of the discharged latent image areas 28 and the undischarged areas not to be developed 30. In the embodiment depicted, the developer roller 18 is biased to a potential of approximately −600 volts. Negatively charged toner 32 is attracted to the more-positive discharged areas 28 on the surface of the photoconductive unit 12 (i.e., −300V vs. −600V).The toner 32 is repelled from the less-positive, non-discharged areas 30, or white image areas, on the surface of the photoconductive unit 12 (i.e., −1000V vs. −600V), and consequently, the toner 32 does not adhere to these areas. As is well known in the art, the photoconductive unit 12, developer roller 18 and toner 32 may alternatively be charged to positive voltages.

In this manner, the latent image on the photoconductive unit 12 is developed by toner 32, which is subsequently transferred to a media sheet 106 by the positive voltage of the transfer device 20, approximately +1000V in the embodiment depicted. Alternatively, the toner 32 developing an image on the photoconductive unit 12 may be transferred to an ITM belt 114 and subsequently transferred to a media sheet 106 at a second transfer location (not shown in FIG. 2, but see location 122 in FIG. 1). In certain instances, such as during inter-page system adjustment procedures, the toner 32 of the developed image may be transferred to the ITM belt 114 or, in the case of a single-transfer device, a transport belt (not shown). The cleaning blade 22 removes any remaining toner from the photoconductive unit 12, and the photoconductive unit 12 is again charged to a uniform level by the charging device 14.

The above description relates to an exemplary image forming unit 10. In any given application, the precise arrangement of components, voltages, and the like may vary as desired or required. As is known in the art, an electrophotographic image forming device may include a single image forming unit 10 (generally developing images with black toner), or may include a plurality of image forming units 10, each developing a different color plane separation of a composite image with a different color of toner (generally yellow, cyan and magenta, and optionally also black).

The difference in potential between non-discharged areas 30 on the surface of the photoconductive unit 12—that is, white image areas or areas not to be developed by toner—and the surface potential of the developer roller 18 is known as the "white vector." This potential difference (with the white image areas 30 on the surface of the photoconductive unit 12 being less positive than the surface of the developer roller 18 in the embodiment depicted) provides an electro-static barrier to the development of negatively charged toner 32 on the white image areas 30 of the latent image on the photoconductive unit 12. A sufficiently high white vector is necessary to prevent toner development in white image areas; however, an overly large white vector detrimentally affects the formation of fine image features, such as small dots and lines. In exemplary embodiments of image forming devices, a white vector of 200-250V results in acceptable image quality while preventing toner development in white image areas. Unfortunately, the optimal white vector for each image forming unit 10 within an image forming device may be different, due to environmental conditions, differing toner formulations, component variation, difference in age or past usage levels of various components, and the like. Controller 40, via sensor 126, monitors toner 32 formation on media sheet 106 or belt 114 and adjusts the surface potential of the surface of photoconductive unit 12 (via charging device 14) and the surface potential of developer roller 18. Thus, while exemplary voltages (e.g., −1000V and −600V) are explicitly shown in FIG. 2, actual operating voltages may be adjusted from these exemplary voltages by controller 40 implementing the teachings provided herein.

In an exemplary embodiment, controller 40 at least partially manages the formation of a predetermined pattern of toner 32 on a substrate, which may comprise a media sheet 106 or belt 114 (e.g., a transfer or ITM belt). A toner patch sensor 126 detects a luminosity, luminance, or reflectance of the transferred pattern and controller 40 adjusts the bias voltage of the charging device 14 and/or developer roller 18 as needed to optimize image formation at least partly based on information provided by the toner patch sensor 126. The toner patch sensor 126 may be configured to sense the developed patterns 32 on a substrate 106, 114. Additionally, or alternatively, the toner patch sensor 126 may be configured to sense the developed patterns 32 on the surface of the photoconductive unit 12. Generally, the toner patch sensor 126 may be disposed adjacent any toner carrying surface to sense luminosity, luminance, or reflectance of toner 32, the underlying toner carrying surface, or both. Also, in certain instances, it may be desirable to print toner on toner images (e.g., black on yellow or other combinations) to achieve greater contrast between the developed image and the toner carrying surface. Thus, the toner carrying surface may comprise a solid toner patch of a different color disposed on the substrate 106, 114 or the photoconductive unit 12. Controller 40 establishes an operating point that will prevent background noise while creating a developed image with fine detail that approaches a desired standard.

Initially, one or more solid toner patches are developed and transferred to the substrate 106, 114 to determine an appropriate bias level for developer roll 18. The solid toner patches 32 are transported towards toner patch sensor 126, which measures a reflectance or luminosity of the solid toner patch. Various quantities may be sensed by the toner patch sensor 126 depending on the choice of color model. In one embodiment where an L-A-B color model is used, the L component (luminance or lightness) may be measured for black, cyan, and magenta toner patches while the B chromatic component may be measured for yellow toner patches. In either case, the detected value provides a measure of the density of the developed toner patch. The process may be repeated over a range of developer bias values with toner patch sensor 126 measurements taken at each value. The controller 40 may then adjust the developer bias accordingly to achieve a target solid color. During this process, the toner patch sensor 126 also determines the luminance or reflectance of the background. In the absence of unwanted toner, the detected value is simply the luminance or reflectance of the toner carrying surface, which may be the underlying substrate 106, 114, or the surface of the photoconductive unit 12.

Figure 3:
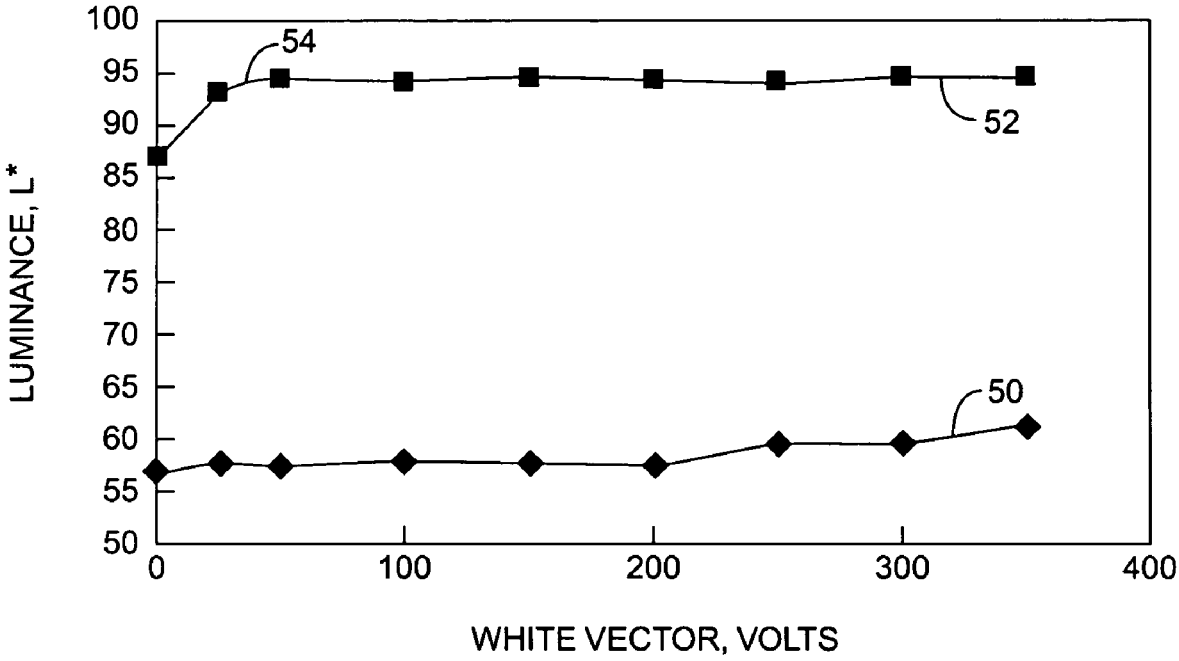
FIG. 3 is a graphical representation of the relationship between luminance and white vector according to one embodiment of the present invention.

With the developer roller 18 bias established relative to the discharge bias of latent images 28 on the surface of the photoconductive unit 12, the white vector may now be determined relative to the developer roller 18 bias. That is, in this exemplary embodiment, the white vector is established by adjusting the charging device 14 bias level while maintaining a fixed developer roller 18 bias. FIG. 3 graphically shows the effect of white vector on the luminance L* (and hence, density) of an exemplary solid patch, indicated by reference number 50. FIG. 3 also shows a similar effect on an exemplary background area, indicated by reference number 52. Similar curves may be produced if other color vectors (e.g., B*) and other color models (e.g., RGB, HSB, etc . . . ) are used. The background area represented in FIG. 3 is an area of a developed image that is intended to be free from toner. The luminance values L* may be detected using a toner patch sensor 126 as previously discussed and shown in FIGS. 1 and 2. The luminance values L* of the background area are detected for the substrate, which may comprise a media sheet 106 or an internal belt 114 (transfer or ITM).

As FIG. 3 shows, the curve 50 representing luminance L* of the solid toner patch is generally flat for white vector values in the range of about 0-200 volts. As the white vector increases above this range, luminance L* begins to increase, indicating that the substrate 106, 114 is beginning to appear in areas that are intended to be covered with toner 32. Since the exemplary substrate 106, 114 has a higher luminance L* than the toner 32, the net effect is that the luminance of the toner patch increases at large white vector values due to insufficient toner coverage.

FIG. 3 further shows that the upper curve 52 representing the luminance L* of the background area is generally flat except at low white vector values. For the exemplary curve 52 shown, at white vector values in the range below a critical point 54 of about 50 volts, toner noise begins to appear in the background area. Since the exemplary toner 32 has a lower luminance L* than the exemplary substrate 106, 114, the net effect at low white vector values is that the luminance of the background decreases due to toner deposition in the background areas. Consequently, for the present example shown in FIG. 3, an optimal value for white vector appears to be within the range of about 50 volts to about 200 volts.

While it may be possible to set a fixed white vector in the middle of this range, the exemplary curves 50, 52 change over time and the optimal white vector range may shift up or down depending on factors such as toner and substrate types, environment, imaging device components, and age. Thus, the procedure outlined in FIG. 4 represents one embodiment for periodic determination of an ideal white vector.

Figure 4:
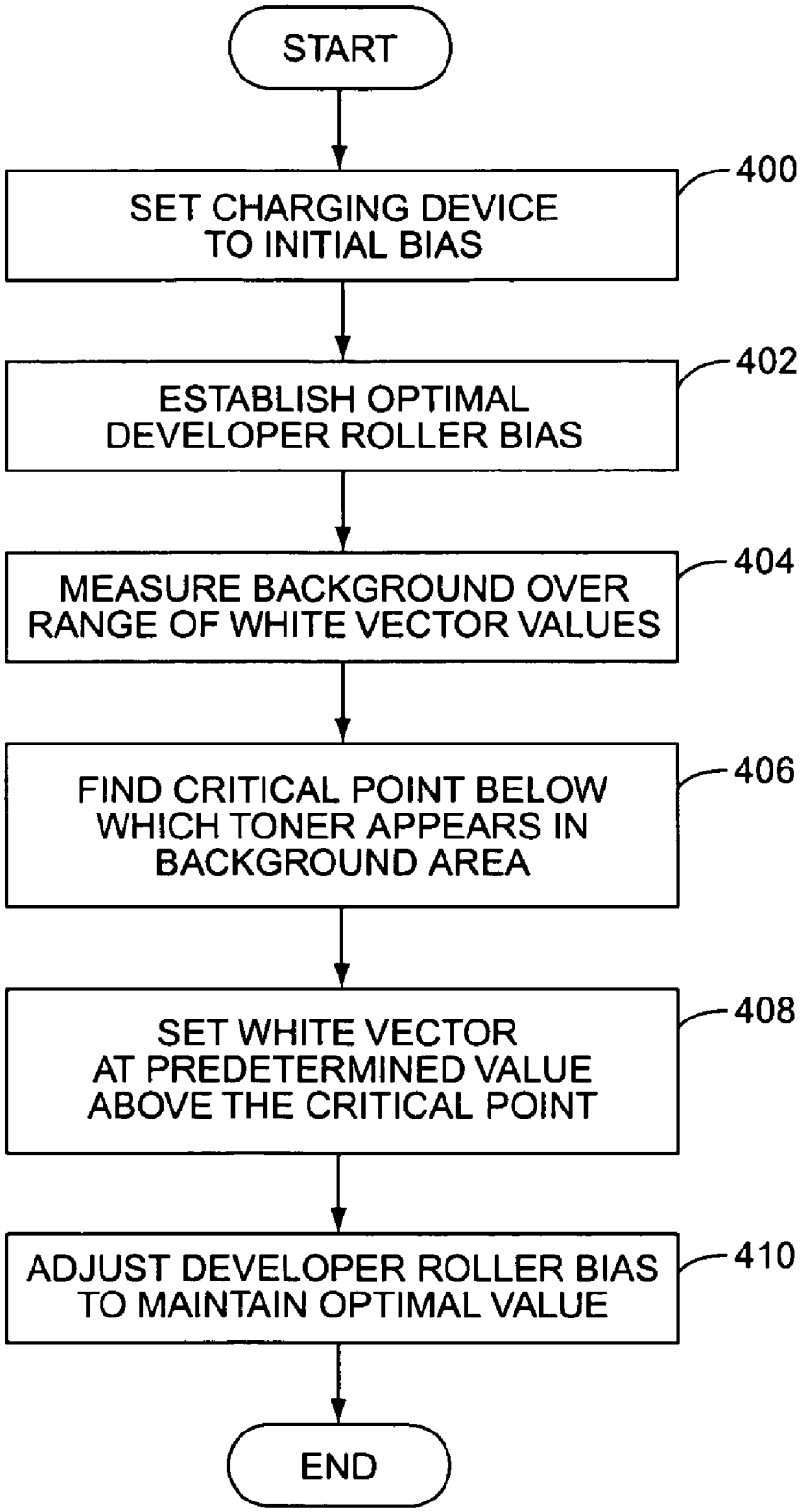
FIG. 4 is a flow diagram of one method of setting a white vector according to the present invention.

Initially, in the exemplary embodiment shown in FIG. 4, the charging device 14 is set to an initial bias, in step 400, to charge the surface of the photoconductive unit 12. Next, the developer bias is determined in step 402 as discussed above. That is, the luminance of a number of solid toner patches may be measured over a range of developer roller 18 bias values and the operating point is set at a point that produces a desired target value for L*. Next, in step 404, the luminance of a background area of a developed image is measured over a range of white vector values to detect a critical point (step 406) at which toner noise or background noise appears in background areas that are intended to be free from toner. Then, the white vector is set to some predetermined value above this critical point (step 408). In other words, the white vector is offset by some predetermined value above the critical point to account for operational variations. Thus, for example, in an image forming unit 10 yielding luminance L* curves as shown in FIG. 3, it may be desirable to set the white vector to a value that is between about 50-150 volts above the critical point, which occurs at about 50 volts. Consequently, for this example, white vector may be set in the range between about 100-200 volts. Different white vector values may be similarly determined for each color or each image forming unit 10 in an image forming device 100. Lastly, at step 410, the developer roller 18 bias is adjusted in an effort to maintain an optimal luminance value L*, which may be adversely affected during the process of setting a new white vector. This adjustment may be minor and may be a predicted value or may be determined by sensing the luminance L* of a second series of solid toner patches.

The steps of determining an optimal developer roller bias and determining an optimal white vector value are described above as occurring at different points in time. This temporal separation may be desirable to limit the number of changing variables involved in determining these optimal operating points. That is, the desired toner patch luminance L* may be determined as a function of a variable developer roller 18 bias while the point at which background noise/toner appears may be determined as a function of a variable photoconductor surface potential. However, these distinct operating conditions may be determined at or near the same time if desirable. Furthermore, these operating points may be determined using a common test pattern consisting of solid toner patches separated by sufficiently large background areas. Alternatively, the developer roller bias may be determined using the aforementioned solid toner patches while the white vector is determined using other text or image patterns.

In an alternative embodiment, the white vector is established by detecting a luminance or reflectance of non-solid developed patterns as opposed to detecting unexpected and unwanted toner in a background area. FIGS. 5 and 6 represent image patterns that may be used to establish white vector in this alternative embodiment. More specifically, FIGS. 5A-5D represent a series of closely spaced horizontal lines. For instance, in one embodiment, latent images of horizontal lines having a width of $1/600^{th}$ inch and spaced apart by $1/600^{th}$ inch are developed using different white vector values. A small area of these lines is shown in each of FIGS. 5A-5D. Similarly, FIGS. 6A-6D each reveal a portion of a dot pattern comprised of a series of $1/600^{th}$ inch dots spaced apart by $1/600^{th}$ inch.

Figure 5A:
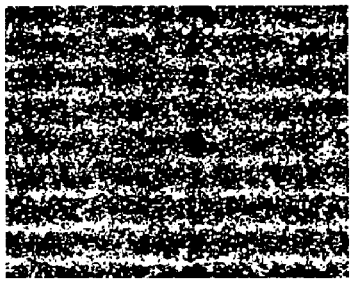
FIGS. 5A-5D are exemplary line patterns used in one embodiment of white vector optimization according to the present invention.
Figure 5B:
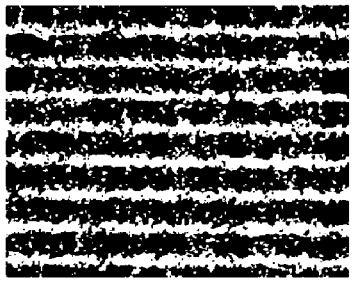
Figure 5C:
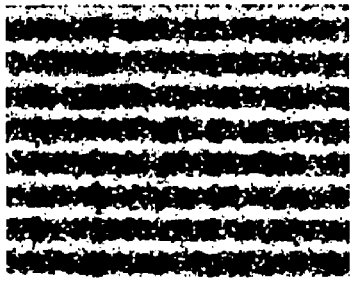
Figure 5D:
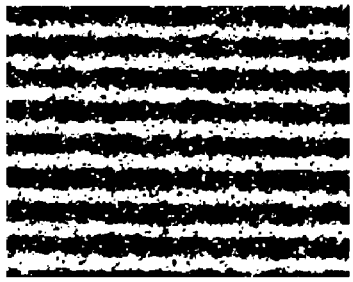
Figure 6A:
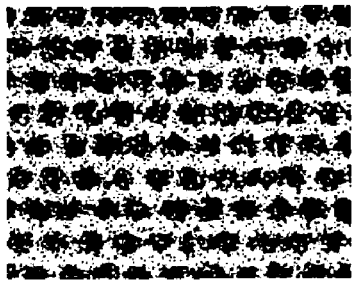
FIGS. 6A-6D are exemplary dot patterns used in one embodiment of white vector optimization according to the present invention.
Figure 6B:
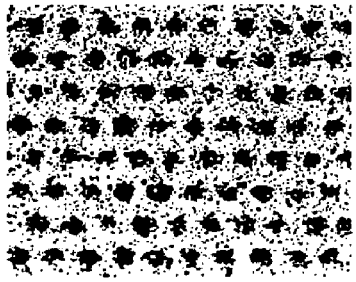
Figure 6C:
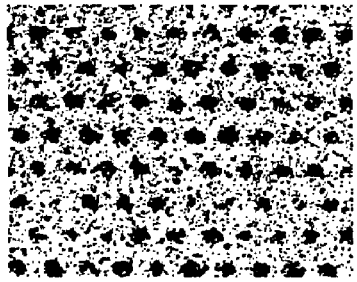
Figure 6D:
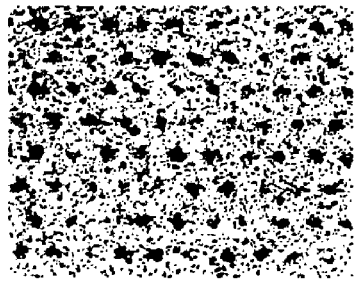

In FIGS. 5A and 6A, the repeating patterns are developed at a white vector value of 150 volts. In FIGS. 5B and 6B, the repeating patterns are developed at a white vector value of 200 volts. In FIGS. 5C and 6C, the repeating patterns are developed at a white vector value of 250 volts. In FIGS. 5D and 6D, the repeating patterns are developed at a white vector value of 300 volts. A noticeable characteristic of these Figures is that, as white vector increases from FIG. 5A to 5D and from FIG. 6A to 6D, the amount of toner coverage decreases. However, the laser exposure is the same for those developed patterns shown in FIGS. 5A-5D and FIGS. 6A-6D, respectively. Thus, developed images, such as those shown in FIGS. 5A-5D and 6A-6D, produce actual toner coverage that may or may not be the same as the exposed image. The term "bloom" represents a description of the extent to which a printed detail is wider or narrower than was intended, which results in printed area coverages that are larger or smaller than intended.

In terms of the patterns shown in FIGS. 5A-5D and FIGS. 6A-6D, bloom may be described as the ratio of actual toner width to ideal toner width. Measuring the width of small features such as these inside an image forming device 10 is impractical. However, the previously mentioned toner patch sensor 126 may be used to measure the reflectivity of these developed patterns, as well as solid toner patterns, and the underlying surface. Given these reflectance values, bloom may be estimated by:

$$\text{Bloom} = \frac{L*\text{substrate} - L*\text{pattern}}{(L*\text{substrate} - L*\text{solid}) \times \%_\text{Ideal_Coverage}}$$

where L*substrate represents the reflectivity of the toner carrying surface, L*pattern represents a measured reflectivity of an area of the pattern, L*solid represents a reflectivity of a solid toner patch, and %_Ideal_Coverage represents a known percentage of the area that should be covered with toner. As indicated above, the toner carrying surface may be a substrate 106, 114, the photoconductor surface 12, or toner of a different color.

As an example of the use of the above equation, if one assumes that the luminance of a substrate L*substrate is 90 and the luminance of a solid toner patch L*solid is 50 and the alternating line pairs as shown in FIGS. 5A-5D represents an ideal coverage %_Ideal_Coverage of 50%, then the denominator in the above equation equates to a nominal value of (90-50)*0.5 or 20. One can calculate that the numerator in the above equation also equals 20 if the luminance of the measured pattern L*pattern equals 70, which is 50% of the difference between L*substrate and L*solid. Thus, actual toner coverage of the developed pattern most closely matches expected or desired toner coverage when the bloom ratio approaches unity. Note also that a luminance of the measured pattern L*pattern that tends towards L*substrate represents less toner coverage, more substrate exposure, and a bloom that is less than one. Conversely, a luminance of the measured pattern L*pattern that tends towards L*solid represents more toner coverage, less substrate exposure, and a bloom that is greater than one.

Figure 7:
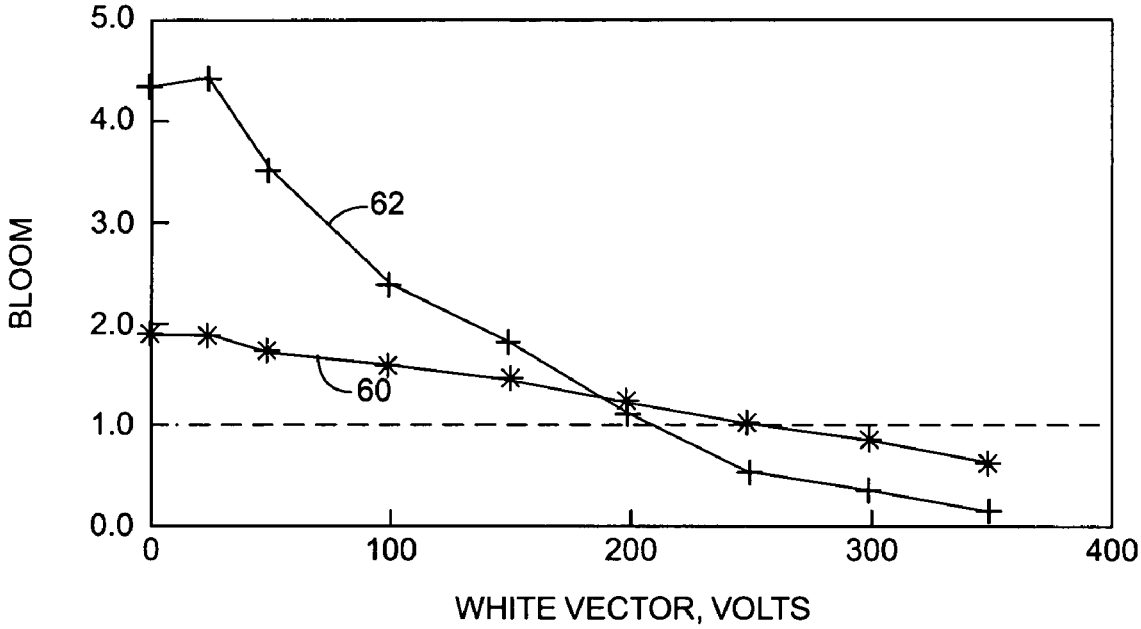
FIG. 7 is a graphical representation of the relationship between bloom and white vector according to one embodiment of the present invention.

The effect of white vector on bloom is shown graphically in FIG. 7, which shows bloom curves for a horizontal line pattern 60 and a dot pattern 62. The bloom curve 62 for the exemplary dot pattern shows that fine dot features are generally more sensitive to white vector than comparably spaced line features. This generalization is confirmed by viewing FIGS. 6A-6D and noting the extent to which the dot pattern coverage varies as white vector varies. Note also that FIG. 7 shows the exemplary line pattern to be less sensitive to white vector. However, both curves 60, 62 approach a bloom of about 1 in the white vector range between about 200 and 300 volts. As discussed above, this range may move up or down depending on actual operating conditions.

Figure 8:
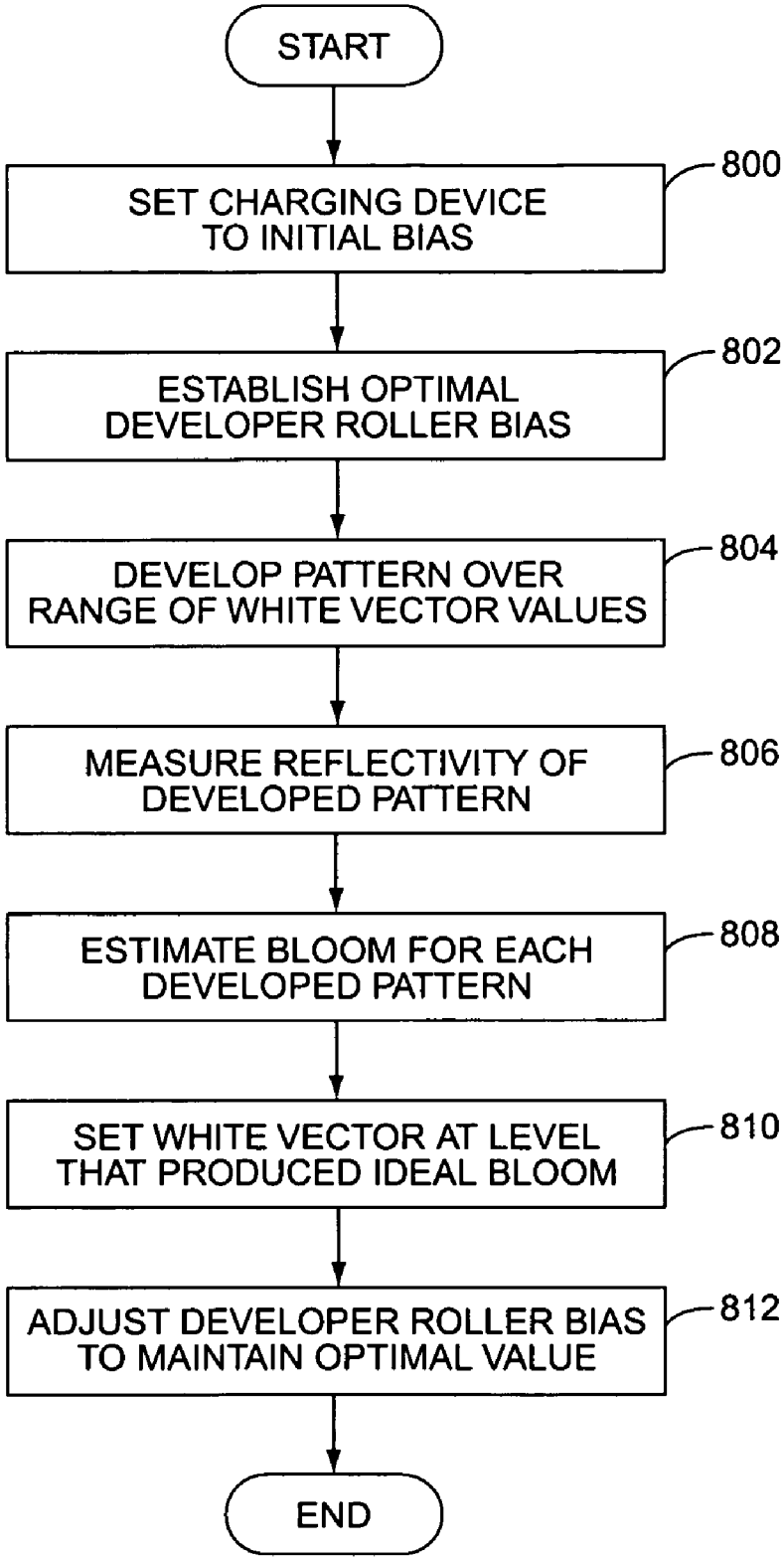
FIG. 8 is a flow diagram of one method of setting a white vector according to the present invention.

Given this knowledge of the relationship between reflectivity, bloom, and white vector, an ideal white vector may be determined using the procedure outlined in FIG. 8. As discussed above, the procedure may be initiated at step 800, where the charging device 14 is set to an initial bias to charge the surface of the photoconductive unit 12. The process continues at step 802 by determining an optimal developer roller 18 bias by measuring the luminance of a number of solid toner patches over a range of developer roller 18 bias values and setting the operating point at a point that produces a target value for luminance L*. Then, at step 804, a predetermined pattern, such as the line or dot patterns shown in FIGS. 5A-5D or 6A-6D, is developed and transferred onto a substrate (e.g., sheet 106, belt 114) over a range of white vector values. Patterns other than those shown in FIGS. 5A-5D and 6A-6D may be used, including thicker or thinner or more or less sparse lines and dots. Vertical lines may also be used. At step 806, the reflectivity of each of the developed and transferred patterns is measured and this reflectivity is used, in step 808, to estimate the bloom or coverage of the pattern. At step 810, the white vector is selected at a value that produces an ideal bloom. In one embodiment, the ideal bloom is about 1. It may also be desirable to interpolate between data points to more closely approximate an ideal bloom. Lastly, at step 812, the developer roller 18 bias is adjusted in an effort to maintain an optimal luminance value L*, which may be adversely affected during the process of setting a new white vector. This adjustment may be minor and may be a predicted value or may be determined by sensing the luminance L* of a second series of solid toner patches.

Figure 9:
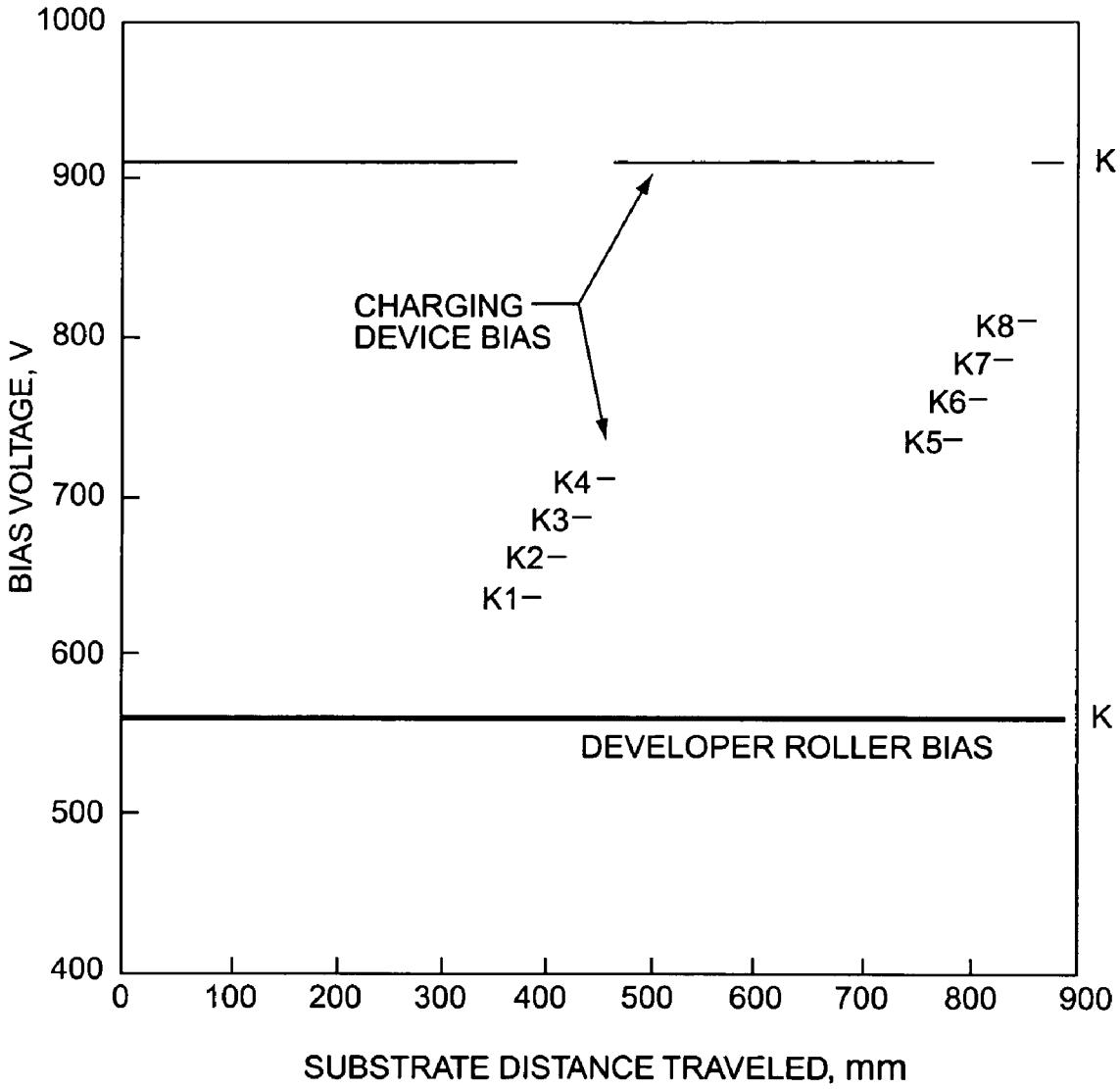
FIG. 9 is a schematic diagram showing incremental white vector bias voltage changes according to one embodiment of the present invention.

FIG. 9 shows exemplary bias voltages of a developer roller 18 and an associated charging unit 14 of an exemplary image forming unit 10. Only one color (e.g., black) is presented in FIG. 9, though it should be understood that similar curves may be generated during the process of determining an optimal white vector for other image forming units 10. FIG. 9 graphically depicts how charging unit 14 bias voltage is changed during one embodiment of white vector determination in an image forming device 100 having an endless ITM belt 114. The horizontal axis represents the passage of time, but, for a substrate or an ITM belt moving at a constant speed, also translates to a distance traveled by the substrate or ITM belt. In one embodiment, the width of FIG. 9 represents one complete revolution of an ITM belt.

The lower line in FIG. 9 represents a developer roller 18 bias labeled K, indicating a bias level for a black developer roller 18. The exemplary developer roller 18 bias is in the range between about 550 and 575 volts. The uppermost line in FIG. 9 represents a charging device 14 bias, again labeled K. This exemplary upper charging device 14 bias is offset from the lower developer roller 18 bias (i.e., the white vector) by a nominal value of about 350 volts. The upper charging device 14 bias curve is broken during periods when white vector is varied for developing and transferring test patterns onto a substrate. For instance, the four bias voltages labeled K1-K4 each represents a white vector value that corresponds to discrete, developed test patterns. Bias voltages K1-K4 are each separated by a value of about 25 volts, though other increments are possible. The next four test patterns K5-K8 correspond to black patterns printed over another range of black charging device 14 biases. For color image forming devices 10, the process may also include eight yellow patterns, eight cyan patterns, and eight magenta patterns, for a total of 32 patterns (eight for each color).

At the end of this procedure, multiple patterns will have been developed and checked for reflectance using the aforementioned toner patch sensor 126. Thus, controller 40 has access to reflectance data for eight patterns for each color over a white vector span of about 200 volts. Wider bias voltage increments between patterns will produce a larger span with less resolution. Thus, the process may be repeated by initially checking reflectances of the patterns over a large span and then over progressively smaller spans to pinpoint the optimum bloom and optimum white vector. Alternatively, the data may be interpolated to determine optimum bloom and optimum white vector.

Another advantage of the present embodiment is that the optimization process can occur between print jobs in a single pass of the ITM belt. For an exemplary belt that is approximately 900 mm as shown in FIG. 9 and a process speed of about 25 ppm, the white vector testing process can be executed in under 10 seconds. Thus, the procedure may be completed without undue constraints on resources and uptime. In addition, toner deposited on belt 114 during the aforementioned procedures is cleaned by cleaner unit 128 (see FIG. 1) to prevent media sheet contamination during subsequent print jobs.

Two general procedures, as shown in FIG. 4 and FIG. 8, have been outlined for establishing an optimal white vector. However, these two procedures are not necessarily exclusive of one another. An alternative embodiment may use aspects of both procedures to determine an optimal white vector. For instance, it may be possible for a white vector optimization using the ideal bloom approach outlined in FIG. 8 to produce unwanted background toner as detected by the procedure in FIG. 4. Thus, in one embodiment, optimization of white vector comprises both procedures shown in FIG. 4 and FIG. 8. In one embodiment where both procedures are used and a conflict arises between the two procedures, the background method disclosed in FIG. 4 may be given absolute or weighted priority over the bloom approach disclosed in FIG. 8. This latter requirement guarantees that a final image will have no background toner at the expense of feature detail. Another embodiment may give priority to white vector values established by the procedure outlined in FIG. 8, thus placing importance on feature detail over unwanted background toner.

Those skilled in the art should appreciate that the illustrated controller 40 shown in FIG. 2 for implementing the present invention may comprise hardware, software, or any combination thereof. For example, circuitry for setting an optimal white vector may be a separate hardware circuit, or may be included as part of other processing hardware. More advantageously, however, the controller 40 circuitry is at least partially implemented via stored program instructions for execution by one or more microprocessors, Digital Signal Processors (DSPs), ASICs or other digital processing circuits included in the image forming device 100. In other embodiments, some or all of the processing steps executed to establish an optimal white vector may be performed in a host computer or other connected computing system.

The present invention may be carried out in other specific ways than those herein set forth without departing from the scope and essential characteristics of the invention. For example, while embodiments described above have contemplated changing white vector by altering a charging device 14 bias relative to a fixed developer roller 18 bias, it is also possible to modify white vector by some combination of altering either or both of the charging device 14 bias and the developer roller 18 bias. Thus, white vector may also be modified by simply modifying developer roller 18 bias relative to a fixed charging device 14 bias, assuming however, that solid area toner reflectance is not adversely affected. The white vector optimization may be incorporated in a variety of image forming devices including, for example, printers, fax machines, copiers, and multi-functional machines including vertical and horizontal architectures as are known in the art of electrophotographic reproduction.

Furthermore, the exemplary image forming device 10 described herein uses contact-development technology—a scheme that implements a physical contact between components to promote the transfer of toner. The white vector optimization may also be incorporated in image forming devices that use a jump-gap-development technology—a scheme that implements a space between components that are involved in toner development of latent images on the photoconductor. The present embodiments are, therefore, to be considered in all respects as illustrative and not restrictive, and all changes coming within the meaning and equivalency range of the appended claims are intended to be embraced therein.

What is claimed is:

1. An electrophotographic image forming device comprising:

a photoconductive unit;

a charger unit operative to charge a surface of the photoconductive unit to a first voltage;

an imaging unit forming a latent image on the surface of the photoconductive unit by selectively discharging the surface of the photoconductive unit to at least a second voltage by illumination thereof;

a developer roller having a surface biased to a third voltage and operative to develop toner to the latent image on the surface of the photoconductive unit;

a substrate onto which the developed image is transferred from the surface of the photoconductive unit;

a sensing unit operative to detect a reflectance of the developed image on the substrate and a reflectance of a non-developed area on the substrate; and a controller operative to produce subsequent images while adjusting the third voltage until a desired reflectance of one of the subsequent images on the substrate is obtained, and then adjust the first voltage to produce a desired reflectance of the non-developed area on the substrate while maintaining the third voltage at the value resulting in the desired reflectance of the one subsequent image.

2. The device of claim 1 wherein the third voltage is intermediate to said first and second voltages.

3. The device of claim 1 wherein the controller adjusts the first voltage to increase the difference between the first voltage and the third voltage when the sensing unit detects the reflectance of toner on portions of the toner carrying surface other than the developed latent image.

4. The device of claim 1 wherein the controller adjusts the first voltage to decrease the difference between the first voltage and the third voltage when the sensing unit does not detect the reflectance of toner on portions of the toner carrying surface other than the developed latent image.

5. An electrophotographic image forming device comprising:

one or more control circuits operative to control the formation of a predetermined latent image on a photoconductor surface charged to a first potential, and development of the latent image by a development roller biased to a second potential, and subsequent transfer of the image onto a substrate;

one or more sensor circuits operative to detect a coverage of the developed latent image on the substrate;

the one or more control circuits further operative to produce subsequent latent images while adjusting the second potential until a desired coverage of one of the subsequent latent images on the substrate is obtained, and then adjust the first potential while maintaining the second potential at the value resulting in the desired coverage of the one subsequent latent image on the substrate in response to a comparison between the detected coverage of the developed latent image and a desired coverage of the developed latent image.

6. The device of claim 5 wherein the one or more sensor circuits are further operative to sense a reflectance of the subsequent latent images and a reflectance of a non-developed area on the substrate, the one or more control circuits operative to determine the coverage of the subsequent latent images based in part on the sensed reflectances.

7. The device of claim 5 wherein the one or more control circuits is further operative to adjust the difference in electrical bias between the first and second potentials in response to whether the one or more sensor circuits detects a reflectance of toner on portions of the substrate other than the developed latent image.

8. The device of claim 5 wherein the one or more control circuits are further operative to adjust the difference in electrical bias between the first and second potentials to match the detected coverage of the subsequent latent images to the desired coverage of the subsequent latent images.

9. The device of claim 5 wherein the detected coverage and desired coverage of the subsequent latent images represent a percentage of the substrate area that is covered with toner.

10. In an electrophotographic imaging device, a method of adjusting a difference in electrical potential between a charged, unexposed photoconductor surface and a developer roll, the method comprising:

repeatedly creating latent images of a predetermined test pattern on said charged, unexposed photoconductor surface by selectively illuminating portions of said photoconductor surface with an optical device;

creating developed test patterns by supplying toner from said developer roll to the photoconductor surface to develop the latent image patterns;

transferring the developed test patterns to a substrate;

measuring a reflectance of each developed test pattern on the substrate and adjusting the developer roll potential after each measurement until a desired reflectance of one of the developed test patterns is obtained; and adjusting the electrical potential of the charged, unexposed photoconductor surface while maintaining the developer roll potential at the value resulting in the desired reflectance of the one developed test pattern in response to the measured reflectance of the developed test pattern.

11. The method of claim 10 further comprising creating the latent image of the predetermined test pattern over a series of differences in electrical potential between the charged, unexposed photoconductor surface and the developer roll and interpolating among the series of differences in electrical potential and setting the electrical potential of the charged, unexposed photoconductor surface to a value that optimizes the measured reflectance of the developed test pattern.

12. The method of claim 10 further comprising:

measuring the reflectance of a solid toner patch disposed on the substrate;

measuring the reflectance of the substrate that is free of toner of the same color as the solid toner patch; and determining an actual area-wise coverage of the developed test pattern on the substrate from the measured reflectances of the developed test pattern, the solid toner patch, and the substrate.

13. The method of claim 12 further comprising comparing the actual area-wise coverage of the developed test pattern to a desired area-wise coverage and adjusting the actual area-wise coverage to more closely match the desired area-wise coverage by adjusting the difference in electrical potential between the charged, unexposed photoconductor surface potential and the developer roll potential.

14. The method of claim 12 further comprising increasing the difference in electrical potential between the charged, unexposed photoconductor surface potential and the developer roll potential upon detecting a reflectance of toner at portions of the toner carrying surface other than the developed test pattern.

15. The method of claim 10 further comprising comparing the measured reflectance of the developed test pattern to a desired reflectance of the developed test pattern and adjusting the measured reflectance to more closely match the desired reflectance by adjusting the difference in electrical potential between the charged, unexposed photoconductor surface potential and the developer roll potential.

16. A method of adjusting a charge voltage of a photosensitive body relative to an associated developer roller in an electrophotographic device, the method comprising:

repeatedly developing a test pattern using said electrophotographic device;

transferring each developed test pattern to a substrate and measuring the coverage or line width of each developed test pattern and adjusting a charge voltage of the developer roller after each measurement until a desired coverage or line width of one of the developed test patterns on the substrate is obtained;

determining bloom by detecting an actual coverage or line width of each test pattern and comparing the actual coverage or line width to a desired coverage or line width; and adjusting said charge voltage of the photosensitive body while maintaining the charge voltage of the developer roller at the value resulting in the desired coverage or line width of the one developed test pattern in response to the determined bloom.

17. The method of claim 16 wherein determining bloom comprises calculating a ratio of values calculated for the actual coverage or line width of the test pattern and the desired coverage or line width of the test pattern.

18. The method of claim 17 wherein the actual coverage or line width of the test pattern is proportional to a difference between a detected reflectance of the test pattern and a detected reflectance of the substrate upon which the test pattern is disposed, and the desired coverage or line width of the test pattern is proportional to a product of a difference between a detected reflectance of a solid toner patch disposed on the substrate and the detected reflectance of a non-developed area on the substrate and an area-wise percentage of the test pattern ideally comprised of toner.

19. The method of claim 16 wherein the test pattern is a dot pattern.

20. The method of claim 16 wherein the test pattern is a line pattern.

21. The method of claim 16 further comprising determining bloom over a range of different charge voltages of said photosensitive body relative to said associated developer roller and setting the charge voltage of said photosensitive body to an ideal bloom level.

22. The method of claim 21 further comprising interpolating between different charge voltages and determining and setting an ideal charge voltage of said photosensitive body that produces the ideal bloom.

23. The method of claim 21 wherein the ideal bloom level is approximately one.

* * * * *